United States Patent [19]

Powell

[11] 4,022,491

[45] May 10, 1977

[54] SKI APPARATUS

[76] Inventor: William Powell, R.D. 1, Box 857, Newton, N.J. 07860

[22] Filed: Dec. 22, 1975

[21] Appl. No.: 643,505

[52] U.S. Cl. ..... 280/618; 280/607; 280/633

[51] Int. Cl.[2] ..... A63C 9/00

[58] Field of Search ..... 280/607, 609, 617, 618, 280/633, 636

[56] References Cited

UNITED STATES PATENTS

| | | | |
|---|---|---|---|
| 2,237,998 | 4/1941 | Neuhauser | 280/636 |
| 2,260,057 | 10/1941 | Rydberg | 280/603 |
| 3,198,537 | 8/1965 | Silberman | 280/617 |
| 3,685,846 | 8/1972 | Schmid | 280/607 |
| 3,758,127 | 9/1973 | Doyle et al. | 280/607 |
| 3,802,714 | 4/1974 | Freegard | 280/607 |
| 3,854,738 | 12/1974 | Fish | 280/607 |
| 3,899,186 | 8/1975 | Matsuda | 280/607 |
| 3,915,466 | 10/1975 | Matsuda | 280/607 |

FOREIGN PATENTS OR APPLICATIONS

| | | | |
|---|---|---|---|
| 214,326 | 3/1961 | Austria | 280/607 |
| 469,492 | 4/1969 | Switzerland | 280/633 |

*Primary Examiner*—Joseph F. Peters, Jr.
*Assistant Examiner*—Milton L. Smith
*Attorney, Agent, or Firm*—Paul J. Sutton

[57] ABSTRACT

A novel ski apparatus is disclosed wherein both of a skier's boots may be movably supported and accommodated on a single ski. Support means are rigidly secured to the ski and a pair of side-by-side, relatively slidable plate means are mounted on the support means. A heel and toe clamp assembly is secured to each plate means and each of the assemblies is longitudinally movable together with its associated plate means so that the skier may selectively advance one or the other boot relative to the remaining boot in accordance with the skiing requirements at a particular time, such as traverse situations. The plate means are retained in and guided by channel-type means that assure their free and accurate sliding movement and means are also provided for limiting the longitudinal movement of the plate means and, therefore, the skier's boots.

7 Claims, 7 Drawing Figures

FIG. 3
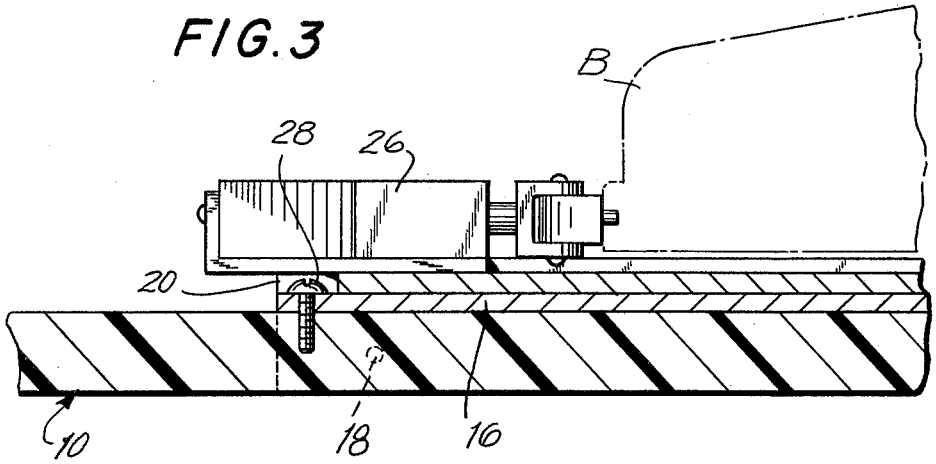
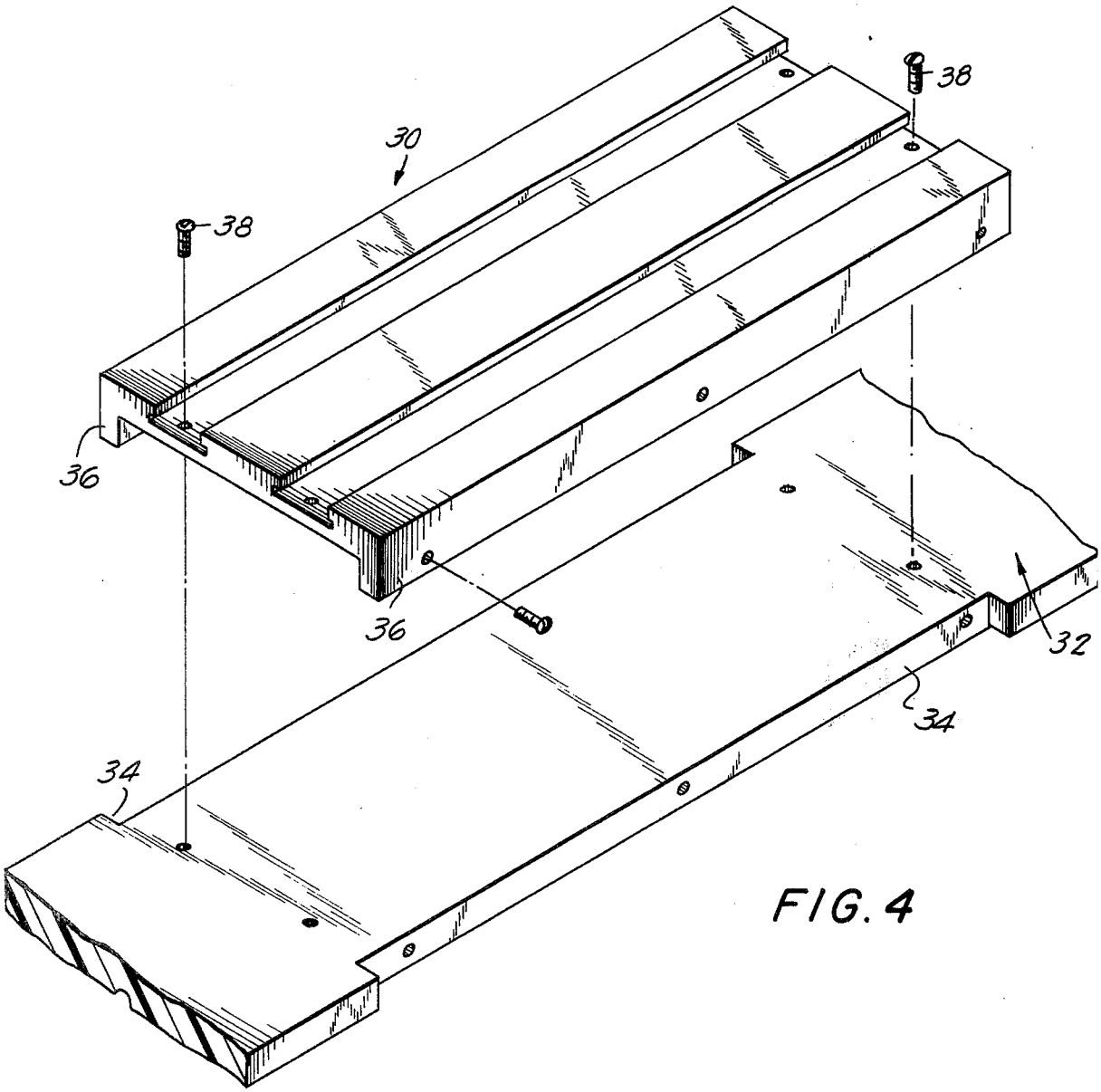
FIG. 4

B
40
42
44
48
50
52
54
56
58
6
60
62
63
64
66
68
70
72

SKI APPARATUS

The present invention relates generally to skiing apparatus and more particularly to a novel, double width ski that may slidably receive both of the skier's boots thereon at the same time.

Normally, two skis are used by the average or weekend skier. However, in the interest of generating excitement, a skier will frequently attempt to traverse a slope on a single ski. My copending application filed on Dec. 19, 1975 and bearing Ser. No. 642,462, discloses an attachment for a ski wherein either the skier's boot or the ski that is not being used during a portion of the run may be supported above the skiing surface. It will be appreciated however, that, as disclosed in my prior copending application, either two skis are used or, where only a single ski is used, that ski can only accommodate one boot on the width thereof.

The present invention contemplates elimination of most of all these limitations and disadvantages of conventional solutions to recognize needs of the art, by providing novel ski apparatus. Accordingly, it is an object of my present invention to provide a novel ski having a width dimension sufficient to accommodate both of the skier's boots thereon at the same time.

Another object of the present invention is to provide an improved, novel ski, as described above, wherein means are included for permitting both the skier's boots to be slidably accommodated thereon.

Yet another object of the present invention is to provide an improved skiing apparatus, as described above, wherein a pair of heel and toe clamping assemblies are provided and means are coupled to the heel and toe clamping assemblies for permitting longitudinal, sliding displacement of one boot relative to the other.

Yet another object of the present invention is to provide an improved ski apparatus, as described above, that may be physically attached to a double or wider width ski.

Still another object of the present invention is to provide improved ski apparatus, as described above, that is integrally molded with the ski during the fabrication thereof.

A specific object of the present invention is to provide an improved ski apparatus, as described above, wherein support means are rigidly secured to the ski and wherein a pair of side-by-side plate means are slidably mounted on the support means, and can be used for water or snow skiing.

Yet another object of the present invention is to provide improved ski apparatus, as described above, wherein the cooperating support means and plate means further include means for guiding the plate means relative to the fixed slide means with the plate means being selectively movable relative to each other.

Yet another object of the present invention is to provide improved skiing apparatus as described above, wherein the guide means is in the form of an elongated, longitudinally extending T-shaped groove formed in the support means.

Still another object of the present invention is to provide improved ski apparatus, as described above, wherein the guide means is comprised of a T-shaped slot formed in each of the plate means for receiving a T-shaped portion of the support means.

The present invention fulfills the above objects overcomes limitations and disadvantages of prior art solutions to problems by providing, according to one aspect of the present invention, a combination of components that define a novel ski of the snow or water types. In one embodiment of the present invention there is provided an elongated ski having a width dimension sufficient to accommodate both of the skier's boots thereon at the same time. Support means are rigidly mounted on the ski either by fasteners or by molding during the fabrication of the ski. A pair of plate means are mounted on the support means in side-by-side relationship and are relatively slidable with respect thereto and with respect to each other and with respect to the underlying ski. A heel and to clamp assembly for a ski boot is mounted on each of the two plate means and both assemblies are independently and selectively movable longitudinally relative to the length of the ski together with the plate means that is associated with each heel and toe clamp assembly. Guide means are used for retaining the plate means during the movement thereof.

In one embodiment of the invention the guide means are in the form of a pair of side-by-side, inverted, T-shaped slots that are formed in the upper surface of the support means for receiving the plate means therein. The support means, in this first mentioned embodiment, is defined by a pair of laterally spaced apart, elongated side walls that are secured to the longitudinal edges of the ski and an elongated transverse wall connecting the side walls with the transverse wall being positioned over the top surface of the ski. Alternatively, the spaced apart side walls of the support means may be made flush with the longitudinal side edges of the ski by notching the side edges of the ski. It is also within the scope of the present invention to eliminate the longitudinal side edges of the support means and fasten the transverse wall of the support means directly to the upper surface of the ski. In this last mentioned alternative structure the fasteners used for securing the support means to the ski may be positioned in the path of the movable plate means in order to provide means for limiting the displacement of the plate means.

Alternatively, the guide means may be formed in the plate means instead of the support means. In such a case, the guide means are comprised of a pair of T-shaped slots formed in the undersurface of the plate means and the support means are in the form of a pair of laterally spaced apart columns having an upper flange that is slidably received in the groove in the plate means. A lower flange portion of the support means may also by T-shaped and embedded in the ski during the manufacture thereof. A pair of vertically oriented columns connect the portion of the support means that are embedded in the ski and the portion of the support means that slide in the groove in each of the plate means. In this last mentioned embodiment the plate means are spacedly supported above the top surface of the ski with the columns that provide the spaced support being made variable in height.

The invention will be more clearly understood from the following description of specific embodiments of the invention, together with the accompanying drawings, wherein similar reference characters denote similar elements throughout the several views and in which:

FIG. 3 is a fragmentary longitudinal sectional elevational view taken along line 3—3 of FIG. 1;

FIG. 4 is an exploded perspective view illustrating a modification of the present invention with several of the components thereof being removed for purpose of clarity;

As is well known, it is frequently necessary when skiing downhill, particularly when moving generally laterally to the downhill direction, to move one (the upper) ski ahead of the other in order to maintain balance. This of course presents a relatively simple procedure when two skis are used. However, when a single ski is used and when both ski boots are mounted on the single ski, a serious balance problem arises that is solved by the present invention.

Figure 1:
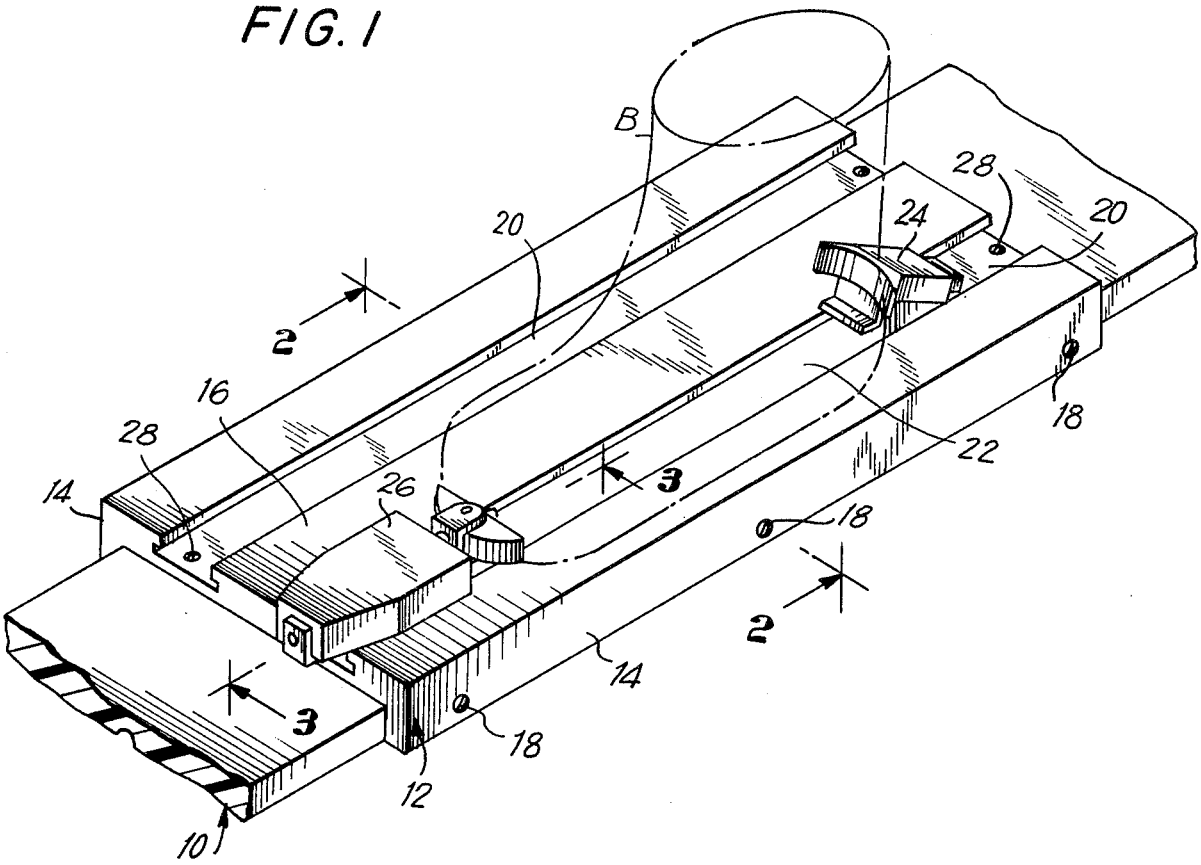
FIG. 1 is a fragmentary, perspective view illustrating one embodiment of the present invention with a typical ski boot shown in phantom outline.

Referring first to FIG. 1, there is shown fragmentarily, a single, double width ski 10 which is mounted a support means generally designated by the reference character 12. In this first embodiment of the present invention, the support means 12 is defined by a pair of laterally spaced apart sidewalls 14 and a transverse wall 16 that connects the side walls 14. The support means 12 rests on the top surface of the ski 10 and is secured to the lateral, longitudinally extending side edges thereof by means of fasteners 18 which pass through the side walls 14 of the support member 12 and which are threaded into the longitudinal side edge of the ski 10. A pair of longitudinally extending, inverted T-shaped slots 20 are formed in the upper surface of the support means 12.

Figure 2:
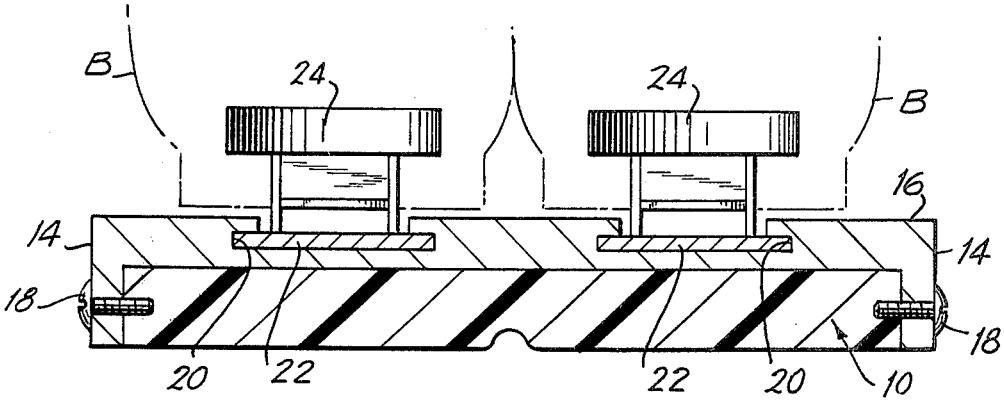
FIG. 2 is a transverse sectional elevational view taken along line 2—2 of FIG. 1.

As shown in FIGS. 2 and 3, a pair of side-by-side elongated plate members 22 are slidably received in the slots 20. A heel assembly 24 and a toe assembly 26 are suitably secured to each of the plate means 22 by any conventional fastener in order to releasably receive a ski boot B. It should be understood that the heel and toe assembly 24 and 26 may be of any conventional, well known type. In order to limit the longitudinal movement of the plate means 22 and hence the heel and toe assemblies 24 and 26 associated therewith as well as the ski boot B, stop means are provided proximate the forward and rearward ends of the slots 22. In one embodiment of the present invention the stop means may take the form of a fastener 28 such as a screw. It will be appreciated that with the boot B properly clamped in the heel and toe clamping assemblies 24 and 26, the skier may selectively and longitudinally move either of the plate assemblies 22 relative to each other and also relative to the ski 10 within the confines of the grooves 20.

Whereas in the first embodiment, the support means 12 straddles the ski 10 and extends laterally beyond the longitudinal side edges thereof, an alternative embodiment shown in FIG. 4 provides for a flush mounted support means 30. All other structure relating to the present invention as shown in FIG. 4 may be the same as shown in connection with the embodiment of FIGS. 1—3 and is therefore not repeated. It will be appreciated that the ski 32 shown in FIG. 4 embodiment is provided with longitudinally extending notches 34 along the side edges thereof in order to receive the longitudinally extending sidewalls 36 of the support means 30. It should be further noted that, the same fasteners 38 that are used to secure the support means 30 to the ski 32 may be used as stop means for the plate means in a manner described in connection with the first embodiment.

Figures 5, 6, 7:
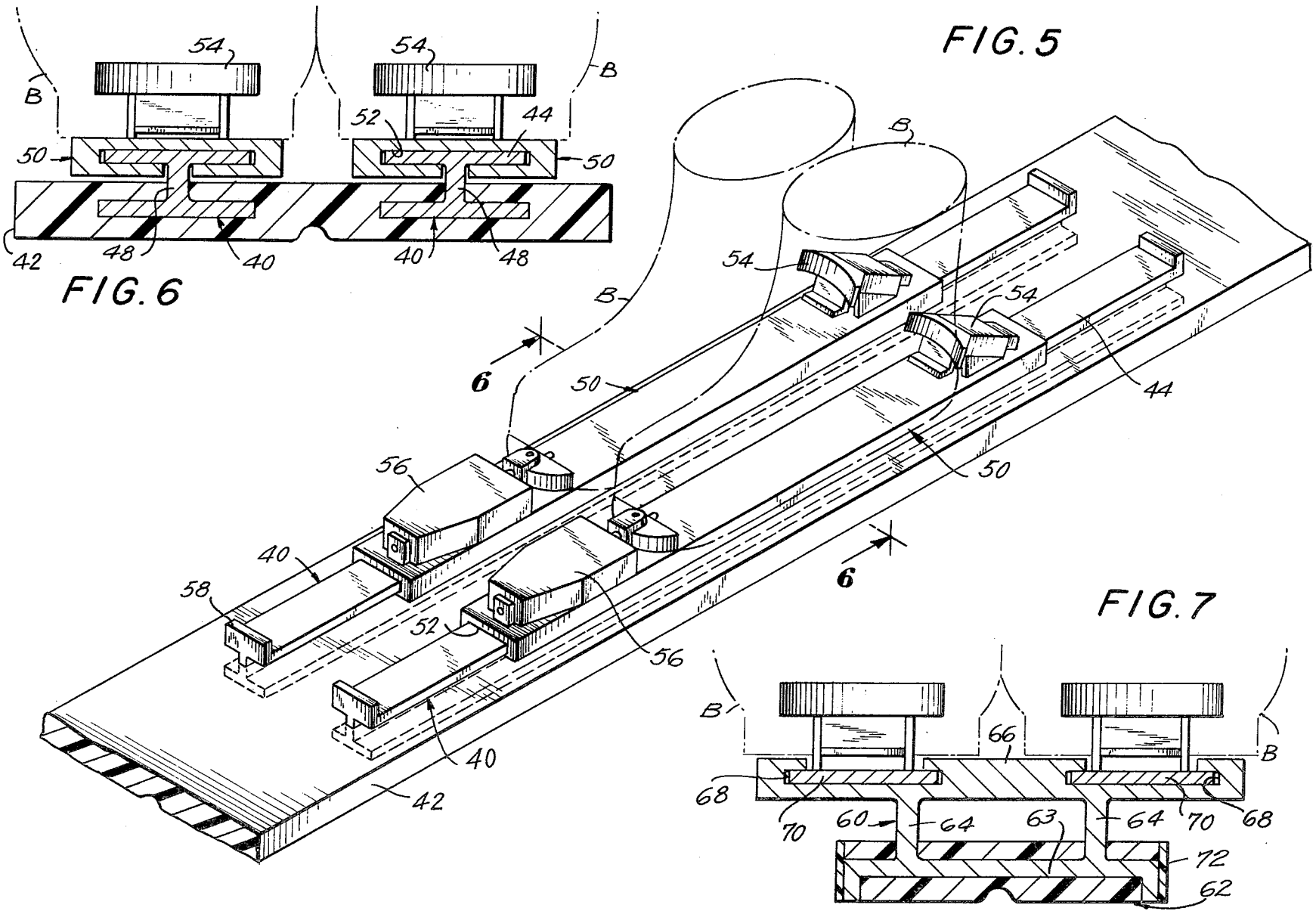
FIG. 5 is a fragmentary, perspective view illustrating an alternative embodiment of the present invention.
FIG. 6 is a transverse sectional elevational view taken along line 6—6 of FIG. 5.
FIG. 7 is a transverse sectional elevational view, similar to FIGS. 2 and 6, illustrating an alternative embodiment of the present invention.

An alternative embodiment of the present invention is shown in FIGS. 5 and 6. Therein it will be seen that a pair of laterally spaced apart, elongated and longitudinally extending support means 40 are embedded in the body of the ski 42 during the manufacture thereof. The support means 40 are generally I-shaped in transverse cross section and are defined by upper and lower transverse flanges 44 and 46, respectively, and a vertically oriented web 48 connecting the flanges 44 and 46. A pair of plate means 50 are each formed with a T-shaped groove 52 in the underside thereof that slidably receives the upper flange 44 and a portion of the web 48 therein. As in the first embodiment, heel and toe clamp assemblies 54 and 56, respectively, are suitably secured to the upper surface of each of the support means 50. In order to provide means for limiting the longitudinal movement of the plate means 50 relative to the support means 40, upturned flanges 58 are formed integrally with the support means 40 and are positioned in the path of the plate means 50.

Still another embodiment of the present invention is shown in FIG. 7. Therein it will be seen that support means which are generally designated by the reference character 60 are embedded in the ski 62 during the manufacture thereof. The support means 60 is comprised of a lower, transverse, longitudinally extending flange 63 and a pair of upright, vetically oriented columns 64. A transverse and longitudinally extending platform 66 is formed integrally with the uppper end of the columns 64 and is provided with a pair of inverted T-shaped grooves 68 for receiving slide means 70 therein. As in the first two described embodiments, heel and toe clamping assemblies of any conventional type may be secured to the upper surface of the plate means 70 so that the boots B are retained by the heel and toe clamping assemblies and said assemblies may be selectively and independently moved longitudinally. If desired, a finishing layer 72 which may be made of glass fibers may be secured along the longitudinal side edges of the ski 62. In this last mentioned embodiment the height of the platform 66 above the top surface of the ski 62 may be made at any convenient dimension.

The embodiments of the invention, particularly disclosed here are presented merely as examples of the invention. Other embodiments, forms and modifications of the invention, coming within the proper scope of the appended claims, will, of course, readily suggest themselves to those skilled in the art. For example, while T-shaped slots have been disclosed and illustrated it will be apparent that dove-tail slots such as are used in precision machinery ways may also be used. It will also be evident that the broadest aspect of the present invention contemplates the provision of means for mounting any type of heel and toe clamp assembly on the slidable plate means and therefore the present invention is not limited to the specific heel and toe clamp assembly that has been illustrated. Moreover, the present invention is not limited to any specific material for the ski or for any component associated therewith. Suitable plastics, metals and combinations thereof may be employed.

What is claimed is:

1. Skiing apparatus comprising: an elongated ski assembly including a base ski, having a width dimension sufficient to accommodate both the skier's boots thereon at the same time; support means carried by said ski; a pair of plate means carried in substantially side-by-side relationship by said support means and which are relatively slidable with respect thereto; means for mounting a heel and toe clamp assembly for a ski boot on each said plate means whereby the heel and toe clamp assemblies are independently and selectively movable longitudinally relative to the length dimension of said ski together with said associated plate means and the ski boots clamped by said assemblies; and guide means for retaining said plate means during the movement thereof, said guide means comprising a groove formed in the surface of each said plate means that is in confronting opposition to upper surfaces of said ski assembly, and said support means comprising a pair of longitudinally extending, elongated side-by-side members having upper and lower ends and a connecting web, said upper ends of said members being received in said slots in said plate means, said lower ends of said side-by-side members being carried by the ski.

2. A ski apparatus according to claim 1 wherein said slots are T-shaped and said members are T-shaped.

3. A ski apparatus according to claim 1 wherein lower flanges of said I-shaped members are embedded within said ski.

4. Skiing apparatus comprising: an elongated ski assembly including a base ski having a width dimension sufficient to accommodate both the skier's boots thereon at the same time; support means carried by said ski, said support means comprising a transverse base wall secured to said ski, column means integral with said base wall and extending upwardly above the top surface of said ski and a platform integral with the upper end of said column means, a pair of plate means carried in substantially side-by-side relationship by said support means and which are relatively slidable with respect thereto; means for mounting a heel and toe clamp assembly for a ski boot on each said plate means whereby the heel and toe clamp assemblies are independently and selectively movable longitudinally relative to the length dimension of said ski together with said associated plate means and the ski boots clamped by said assemblies; and guide means for retaining said plate means during the movement thereof, said guide means comprising a pair of grooves formed in the surface of said platform.

5. A ski apparatus according to claim 4 wherein said transverse basewall is embedded in said ski.

6. A ski apparatus according to claim 4 wherein said pair of grooves comprises a pair of side-by-side, inverted slots formed in the upper surface of said support means for receiving said plate means therein.

7. A ski apparatus according to claim 6 wherein said slots are substantially T-shaped.

* * * * *